US005573150A

United States Patent [19]

Trujillo

[11] Patent Number: 5,573,150

[45] Date of Patent: Nov. 12, 1996

[54] WIRE-FORM MANNEQUIN

[76] Inventor: Juan M. Trujillo, 5746 Florence Ave., South Gate, Calif. 90280

[21] Appl. No.: 515,237

[22] Filed: Aug. 15, 1995

[51] Int. Cl.[6] ..... A47G 25/02

[52] U.S. Cl. ..... 223/66; 223/68; 223/120

[58] Field of Search ..... 223/66, 69, 70, 223/71, 120, 68, 85; 211/13

[56] References Cited

U.S. PATENT DOCUMENTS

| | | | |
|---|---|---|---|
| 1,058,174 | 4/1913 | Greenwald | 223/120 |
| 2,536,187 | 1/1951 | Kosky et al. | 223/68 |
| 2,666,559 | 1/1954 | Wexler et al. | 223/68 |
| 2,669,375 | 2/1954 | Schilling | 223/68 |
| 2,998,903 | 9/1961 | Day | 223/68 |
| 4,917,278 | 4/1990 | Ventimiglia | 223/68 |

FOREIGN PATENT DOCUMENTS

| | | | |
|---|---|---|---|
| 896110 | 5/1962 | United Kingdom | 223/66 |

*Primary Examiner*—Bibhu Mohanty
*Attorney, Agent, or Firm*—David Woon Lee, Esquire; David & Raymond Patent Firm

[57] ABSTRACT

A wire-form mannequin formed by a wire and wire sections bent into a shape of a human torso for hanging, displaying and storing clothes in a presentable manner. The wire-form mannequin comprises a wire bent to provide a plurality of portions including a neck plateau portion, first shoulder support portion, second shoulder support portion, first lateral support portion, second lateral support portion, first hip portion, second hip portion, and a torso end loop portion or a pair of hip wire ends with a wire end cap on each hip wire end, a chest support wire that is either a singular-curve chest support wire or a feminine chest support wire, an abdominal support wire, a holder connecting wire with a cylindrical stand holder, a tripod, a head hanger hook that may be attached to the neck plateau portion, and a pair of lateral hooks that may replace the neck plateau portion. The present invention of a wire-form mannequin is designed to be used with a tripod for standing on a floor and also equipped with a hook or a pair of hooks for hanging.

12 Claims, 6 Drawing Sheets

WIRE-FORM MANNEQUIN

BACKGROUND OF THE PRESENT INVENTION

The present invention relates to a wire-form mannequin, and more particularly to a mannequin formed by a wire and wire sections bent into a shape of a human torso for hanging, displaying and storing clothes in a presentable manner. One of the major features of the present invention of a wire-form mannequin is its usefulness for preventing the distortion of the shape of the clothes due to the clothes' own weight when such wire-form mannequin is used to hang the clothes for display or storage. The present invention has a curve-shaped design that provides sufficient area of contact and support to different parts of the clothes such as coats, jackets, sweaters, dresses, gowns, shirts, vests, tops and the like. When the clothes are properly supported, they are allowed to stay gracefully in a presentable position on this wire-mannequin of the present invention.

The present invention of a wire-form mannequin has advantages over the prior art mannequin and traditional wire coat hanger. It can replaces the prior art mannequin and traditional wire coat hanger and widely used by merchants in stores, shops and factories and by consumers in their offices and household closets. Such advantages are discussed as follows:

A. The Prior Art Mannequin

The prior art mannequin imitates the shape of a human body or torso of a human body in its actual dimensions. The prior art mannequin thus presents the full surface area of a human body or torso of a human body. In this way, it is very inflexible in size. Only a fixed predetermined size of clothes can be put on the prior art mannequin. Its use is therefore limited.

A second disadvantage of the prior art mannequin is that such a statue like object requires a spacious floor area to display the clothes. It is not designed for a small and crowded show room. Because the prior art mannequin takes so much room, it is therefore also impractical for the purpose of storing clothes for ordinary use.

Another disadvantage of the prior art mannequin is its costliness to manufacture, in comparison with the low cost of manufacture of the present invention of the wire-form mannequin.

B. The Traditional Wire Coat Hanger

The traditional wire coat hanger is usually made of metal wire, plastic material, plastic coated metal wire and the like. Compared to the prior art mannequin, the traditional coat hanger is simple to manufacture and easy to use. However, the disadvantage of the prior art traditional wire coat hanger is its small surface area for supporting the clothes and lack of full support to hang and display the clothes is a realistic and presentable manner. Such disadvantage of the traditional wire coat hanger persists regardless whether the wire is made of metal or plastic material.

When the traditional wire coat hanger is used to hang or display clothes, all the weight of the clothes such as coats, jackets, sweaters, dresses, gowns, shirts, vests, tops and the like, will rest completely on the shoulder portions of the traditional wire hanger that are the only portions of the hanger supporting the entire clothes. In this manner, strenuous stress is applied to the fabric of the clothes along the line of contact between the piece of wire of the shoulder portion of the traditional wire hanger and the inner side of the shoulder part of the clothes.

The chest part of a coat, jacket, sweater, dress, gown, shirt, vest, or top cannot be displayed or manifested in a realistic shape as worn by a human body.

Further, when hanged on the traditional wire coat hanger, different parts of the clothes are stretched to different extents, except in a realistic or presentable manner. Since most stress is applied to the lines of contact, which are the shoulder parts of the clothes, shoulder pads of the clothes, if present, are usually subject to compression and extortion, and cannot be presented or displayed in a graceful manner by the traditional wire coat hanger.

The purpose of the present invention is to provide a novel and useful wire-form mannequin that combines the advantages and rids of the disadvantages of both the prior art mannequin and traditional wire coat hanger. Accordingly, this invention provides a supportive framework to hang, display and store clothes in a graceful and presentable manner, with the advantages of requiring minimal space for display and storage, and of relatively very low cost of manufacture.

The present invention of a wire-form mannequin can be used for floor display when in use with a tripod. In that case, the cylindrical stand holder of the wire-form mannequin is placed on the top of a tripod. The present invention of a wire-form mannequin is also equipped with a hook or a pair of hooks and can be hanged in high positions such as overhead nails and ropes along a wall or on top of a partition, or even in use with a common coat hanger, inside a closet for storage, or for display on a wall.

SUMMARY OF THE PRESENT INVENTION

The main object of the present invention is to provide a novel and useful wire-form mannequin as a supportive framework to hang, display and store clothes in a graceful and presentable manner, with the advantages of requiring minimal space for display and storage, and of relatively very low cost of manufacture.

The present invention of a wire-form mannequin is formed by a wire and wire sections bent into a shape of a human torso having curve-shaped portions that provide sufficient areas of contact and support to different parts of the clothes including coats, jackets, sweaters, dresses, shirts, vests, tops and the like. The wire material can be metal, plastic or any suitable material and the wire size is preferably about one-eighth inch of diameter or any workable size for the purpose.

Accordingly, the present invention of a wire-form mannequin comprises a wire bent to provide a plurality of portions including a neck plateau portion, first shoulder support portion, second shoulder support portion, first lateral support portion, second lateral support portion, first hip portion, second hip portion, and a torso end loop portion or a pair of hip wire ends with a wire end cap on each hip wire end, a chest support wire that is either a singular-curve chest support wire or a feminine chest support wire, an abdominal support wire, a holder connecting wire with a cylindrical stand holder, a tripod, a head hanger hook that may be attached to the neck plateau portion, and a pair of lateral hooks that may replace the neck plateau portion.

The present invention of a wire-form mannequin is designed to be used with a tripod for standing on a floor and also equipped with a hook or a pair of hooks for hanging.

LEGENDS OF FIGS. 1 TO 6, INCLUSIVE

Figure 1:
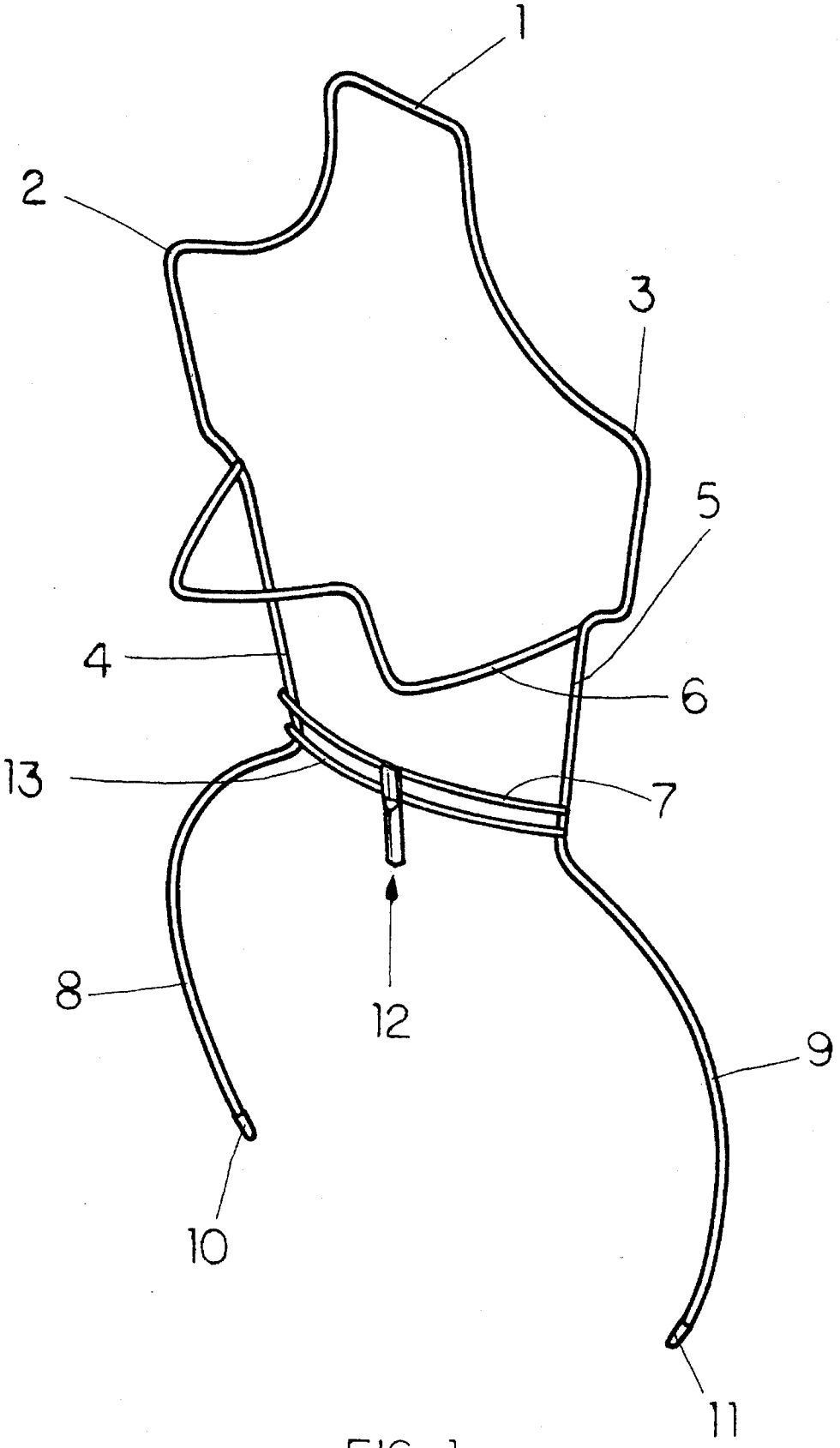
FIG. 1 is a perspective view of a wire-form mannequin according to a first preferred embodiment of the present invention.

1. Neck plateau portion
2. First shoulder support portion
3. Second shoulder support portion
4. First lateral support portion
5. Second lateral support portion
6. Feminine chest support wire
7. Abdominal support wire
8. First hip portion
9. Second hip portion
10. First wire end cap
11. Second wire end cap
12. Cylindrical stand holder
13. Holder connecting wire
14. Singular-curve chest support wire
15. Tripod
16. Stand rod
17. Head hanger hook
18. Second lateral hook
19. First lateral hook
20. Common coat hanger
21. Torso end loop portion
22. First curved tail
23. Second curve tail

DETAILED DESCRIPTION OF THE PREFERRED EMBODIMENT

FIG. 1 illustrates a first preferred embodiment of the present invention of a wire-form mannequin. The wire-form mannequin of this invention comprises a wire bent to provide a plurality of portions including a neck plateau portion 1. A first end of the neck plateau portion 1 is extended into one end of a first shoulder support portion 2; a second end of the neck plateau portion 1 is extended into one end of a second shoulder support portion 3. Another end of the first shoulder support portion 2 is extended into one end of a first lateral support portion 4. Another end of the second shoulder support portion 3 is extended into one end of a second lateral support portion 5. Another end of the first lateral support portion 4 is extended into one end of a first hip portion 8. Another end of the second lateral support portion 5 is extended into a second hip portion 9. Another end of the first hip portion 8 forms a first hip wire end which is inserted into a first wire end cap 10. Another end of the second hip portion 9 forms a second hip wire end which is inserted into a second wire end cap 11.

An feminine chest support wire 6 has a shape of a twin-peak curve line. One end of a feminine chest support wire 6 is connected to the extended portion where the end of the first shoulder support portion 2 meets the end of the first lateral support portion 4. Another end of the feminine chest support wire 6 is connected to the extended portion where the end of the second shoulder support portion 3 meets the end of the first lateral support portion 5. The plane of the feminine chest support wire 6 is about perpendicular to the plane defined by the first shoulder support portion 2, second shoulder support portion 3, first lateral support portion 4 and second lateral support portion 5, rendering an resemblance of the protrusion of a pair of breasts in relation to the plane of a human torso.

An abdominal support wire 7 that has a shape of a slight curve line connects the first lateral support portion 4 and the second lateral support portion. One end of the abdominal support wire 7 is connected to the extended portion where the end of the first lateral support portion 4 meets the end of the first hip support portion 8. Another end of the abdominal support wire 7 is connected to the extended portion where the end of the second lateral support portion 5 meets the end of the first hip support portion 9. The plane of the abdominal support wire 7 is about perpendicular to the plane defined by the first lateral support portion 4, second lateral support portion 5, first hip support portion 8 and second hip support portion 9, rendering an resemblance of the protrusion of an abdomen in relation to the plane of a human torso.

Parallel to and below the abdominal support wire 7 is a holder connecting wire 13 which has a shape of a slight curve line similar to that of the abdominal support wire 7. One end of the holder connecting wire 13 is connected to the upper end of the first hip support portion 8 and another end of holder connecting wire 13 is connected to the upper end of the second hip support portion 9.

A cylindrical stand holder 12 is attached to the middle of the holder connecting wire 13. An opening of the cylindrical stand holder 12 is oriented downward for holding the top end of the stand rod of a tripod. The tripod allows the wire-form mannequin to stand in an erect position and in this manner clothes can be put on the wire-form mannequin for display and storage when the wire-form mannequin is in use with the tripod.

Figure 2:
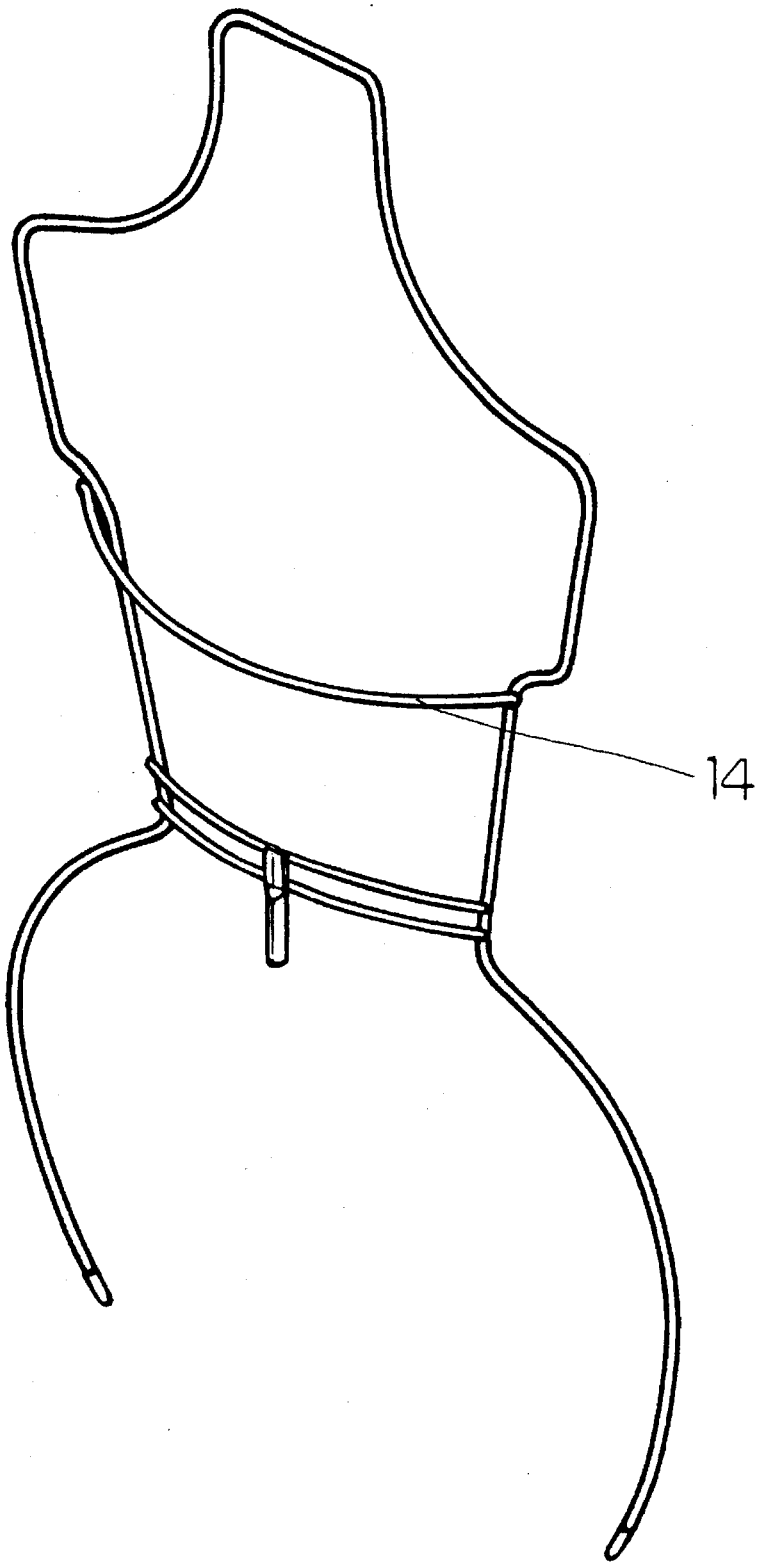
FIG. 2 is a perspective view of a wire-form mannequin according to a second preferred embodiment of the present invention.

FIG. 2 illustrates a second preferred embodiment of the present invention of a wire-form mannequin. Except a singular-curve chest support wire 14 which replaces the feminine chest support wire 6 of FIG. 1, this second preferred embodiment of the wire-form mannequin is identical to the first preferred embodiment of the present invention.

The description of the elements of this second preferred embodiment is the same as in FIG. 1 above except that whenever the element "feminine chest support wire 6" occurs in the text, it is replaced by the new element "singular-curve chest support wire 14." This element of singular-curve chest support wire 14 has a shape of a smooth curve line and is used in practice when the clothes to be displayed or stored on the wire-form mannequin are for men or not meant for emphasizing the natural shape of feminine breasts.

Figure 3:
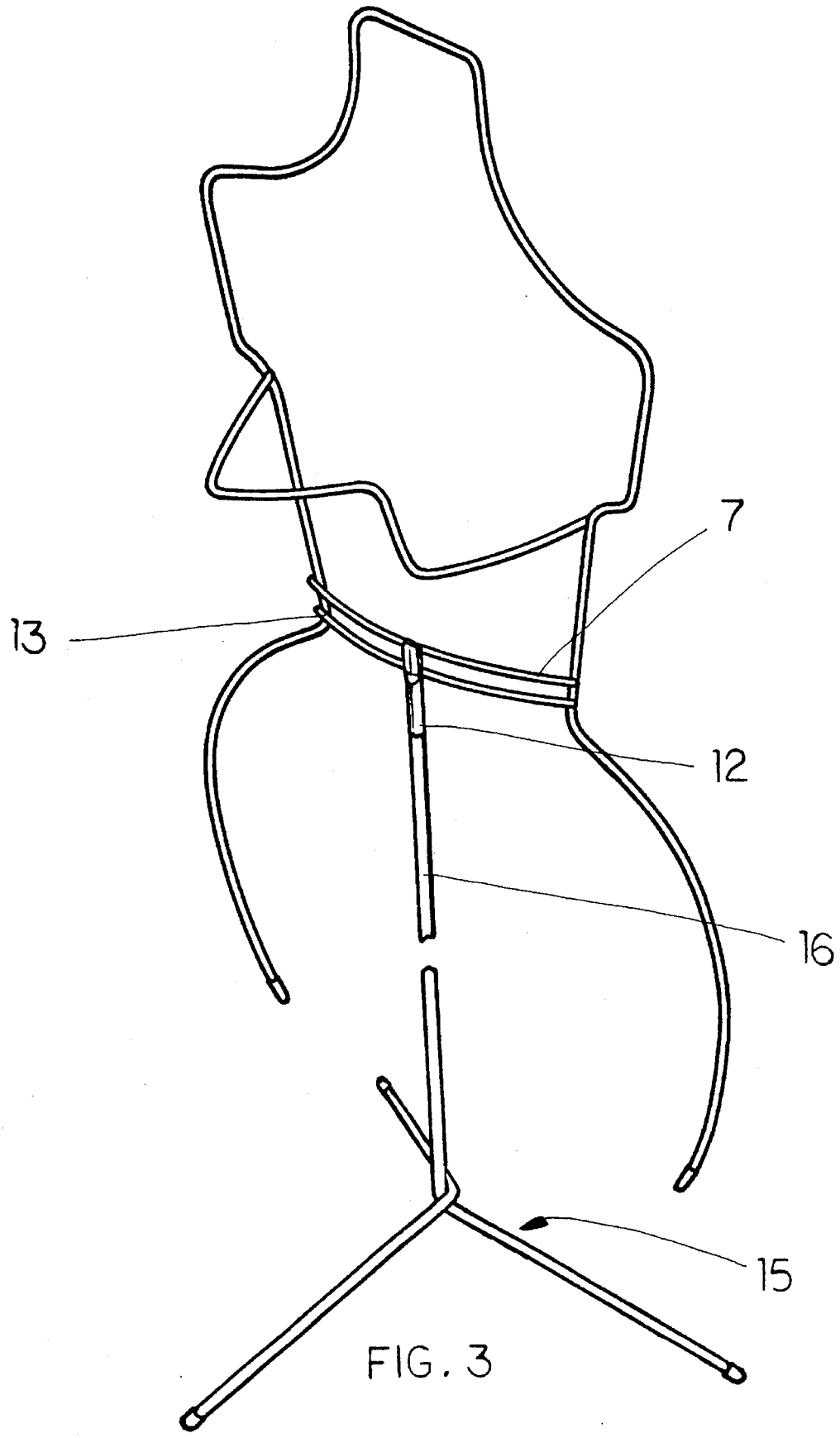
FIG. 3 is an illustrative view of a wire-form mannequin according to a first preferred embodiment of the present invention showing its best mode with a tripod in use.

FIG. 3 illustrates the best mode of the first preferred embodiment of the present invention of a wire-form mannequin in use with a tripod 15. The cylindrical stand holder has its opening pointing downward. When the wire-form mannequin is in use with the tripod 15, the tip of the stand rod 16 of the tripod 15 is inserted into the cylindrical stand holder 12. The wire-form mannequin is thus supported by the tripod 15 and is allowed to maintain an erect position for displaying and storing clothes.

Figure 4:
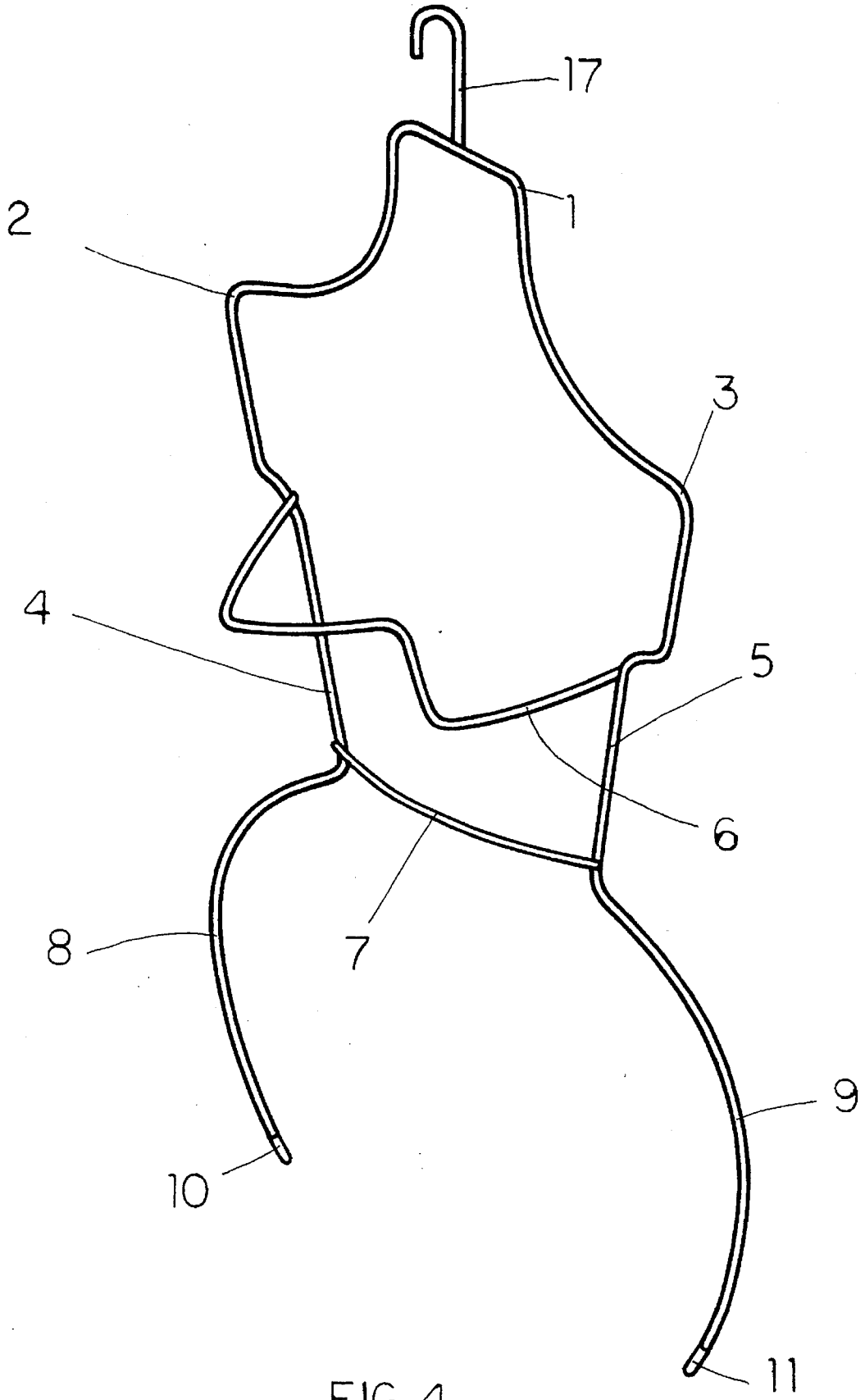
FIG. 4 is a perspective view of a wire-form mannequin according to a third preferred embodiment of the present invention.

FIG. 4 illustrates a third preferred embodiment of the present invention of a wire-form mannequin. Except an additional element of a head hanger hook 17 being attached to the middle of the plateau portion of the neck plateau portion 1, and the elimination of the elements of the holder connecting wire 13 and cylindrical stand holder 12 of FIG. 1, this third preferred embodiment of the wire-form mannequin is identical to the first preferred embodiment of the present invention.

The description of the elements of this third preferred embodiment is the same as in FIG. 1 above except that any description of the elements of the holder connecting wire 13 and cylindrical stand holder 12 is deleted and that additional description of the head hanger hook 17 is included as follows:

A head hanger hook 17 is attached to the middle of the plateau portion of the neck plateau portion 1. Such head hanger hook is used in practice when this preferred embodiment of the wire-form mannequin is not in use with a tripod for standing, and is a device to be used with any attachment for hanging. With this element of the head hanger hook 17, the wire-form mannequin can be hanged on any suitable attachments, high or low, such as overhead nails on a wall, ropes tied along a wall, or the top of a partition. Therefore, this third preferred embodiment of the present invention can also be put in user inside a closet for storage or for display on a wall.

Figure 5:
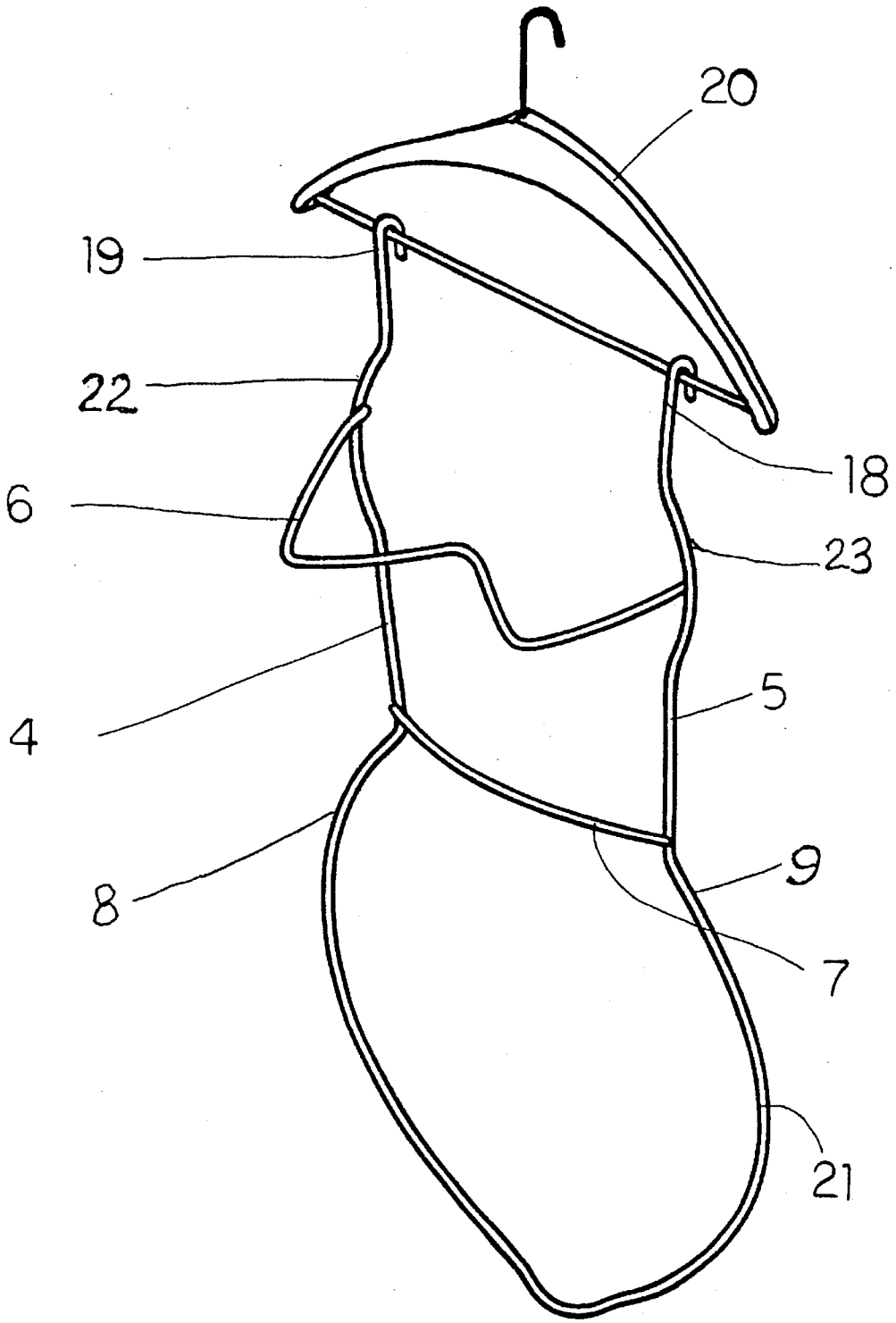
FIG. 5 is an illustrative view of a wire-form mannequin according to a fourth preferred embodiment of the present invention showing its best mode with a common coat hanger in use.

FIG. 5 illustrates a fourth preferred embodiment of the present invention of a wire-form mannequin, which is specially designed for dresses and gowns. The special features of this fourth preferred embodiment of the invention include a first curved tail 22 at the lower end of a first lateral hook 19 and a second curved tail at the lower end of a second lateral hook 18, and torso end loop portion 21.

The first curved tail 22 and second curve tail 23 provide additional frontal protrusion and support for the chest portion of feminine dresses and gowns. Together with the feminine chest support wire, these curve tails 22,23 can greatly enhance the chest portion of feminine clothes.

Another feature in this preferred embodiment that is designed to enhance the shape of a dress or gown is the torso end loop portion 21 which has an exaggerated hip form and its loop shape offers stronger support than a pair of open wire ends and thus can give full support to the hip portion of a dress or gown resulting in stretching out the hip portion to its fullest extent in a splendrous manner.

In this preferred embodiment, the wire-form mannequin is not used with a tripod because a tripod may not be tall enough for a long dress or gown. A pair of lateral hooks 19 and 18 are designed for hanging the wire-form mannequin in a high position to fully display or properly store a long dress or gown.

The wire-form mannequin of this invention comprises a wire bent to provide a plurality of portions including a first lateral hook. 19 and a second lateral hook 18. A non-hook end of the first lateral hook 19 has a first curved tail 22 which is extended into one end of a first lateral support portion 4; a non-hook end of the second lateral hook 18 also has a second curved tail 23 which is extended into one end of a second lateral support portion 5. Another end of the first lateral support portion 4 is extended into one end of a first hip portion 8. Another end of the second lateral support portion 5 is extended into one end of a second hip portion 9. Another end of the first hip portion 8 and another end of the second hip portion 9 are extended to form a torso end loop portion 21.

One end of a feminine chest support wire 6 is connected to the first curved tail 22 of the first lateral hook 19. Another end of the feminine chest support wire 6 is connected to the second curved tail 23 of the second lateral hook 18. The plane of the feminine chest support wire 6 is about perpendicular to the plane defined by the first lateral support portion 4 and second lateral support portion 5, rendering an resemblance of the protrusion of a pair of breasts in relation to the plane of a human torso.

An abdominal support wire 7 connects the first lateral support portion 4 and the second lateral support portion. One end of the abdominal support wire 7 is connected to the extended portion where the end of the first lateral support portion 4 meets the end of the first hip support portion 8. Another end of the abdominal support wire 7 is connected to the extended portion where the end of the second lateral support portion 5 meets the end of the first hip support portion 9. The plane of the abdominal support wire 7 is about perpendicular to the plane defined by the first lateral support portion 4, second lateral support portion 5, first hip support portion 8 and second hip support portion 9, rendering an resemblance of the protrusion of an abdomen in relation to the plane of a human torso.

Figure 6:
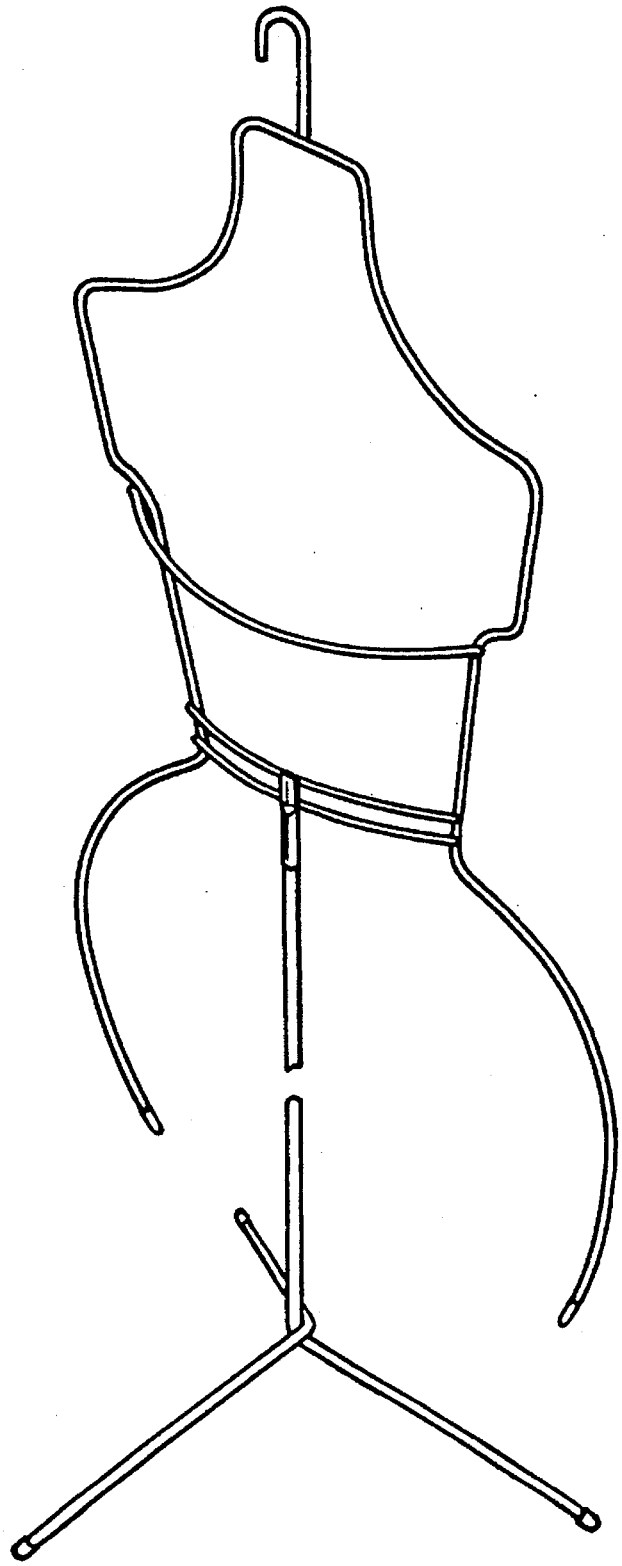
FIG. 6 is an illustrative view of a wire-form mannequin according to a fifth preferred embodiment of the present invention showing its best mode with a tripod in use.

FIG. 6 of the disclosure of the present invention of a wire-form mannequin illustrates a fifth preferred embodiment showing a flexible combination of useful features for adaptation to various conditions of use. In this preferred embodiment, both the head hanger hook 17 and the cylindrical stand holder 12 on its holder connecting wire 13 are co-existent so that the wire mannequin can be either used with a tripod for standing erect as shown in FIG. 6, or used in a hanging manner.

Incorporation of alternate features in the design of the wire-mannequin will render larger utility of this invention.

I claim:

1. A wire-form mannequin comprising a wire bent to provide a plurality of portions including a neck plateau portion, a first shoulder support portion, a second shoulder support portion, a first lateral support portion, a second lateral support portion, a first hip portion, and a second hip portion, a first wire end cap, a second wire end cap, a chest support wire, an abdominal support wire, a holder connecting wire, and a cylindrical stand holder, said neck plateau portion having a first end being extended into one end of said first shoulder support portion and having a second end being extended into one end of a second shoulder support portion, said first shoulder support portion having another end being extended into one end of the first lateral support portion, said second shoulder support portion having another end being extended into one end of the second lateral support portion, said first lateral support portion having another end being extended into one end of the first hip portion, said second lateral support portion having another end being extended into the second hip portion, said first hip portion having a first hip wire end which is inserted into the first wire end cap, said second hip portion having a second hip wire end which is inserted into the second wire end cap, said chest support wire having one end being connected to where said end of said first shoulder support portion meets said end of said first lateral support portion, and having another end being connected to where said end of said second shoulder support portion meets said end of said first lateral support portion, said abdominal support wire having one end being connected to where said end of said first lateral support portion meets said end of said first hip support portion, and having another end being connected to where said end of said second lateral support portion meets said end of said first hip support portion, said holder connecting wire having one end being connected to said first hip support portion and having another end being connected to said second hip support portion, and said cylindrical stand holder being attached to a middle position of said holder connecting wire.

2. A wire-form mannequin according to claim 1 wherein said chest support wire comprises a singular-curve chest support wire, said singular-curve chest support wire having a shape of a smooth curve line.

3. A wire-form mannequin according to claim 1 wherein said chest support wire comprises a feminine chest support wire, said feminine chest support wire having a shape of a twin-peak curve line.

4. A wire-form mannequin according to claim 1 wherein said neck plateau portion has a head hanger hook, said head hanger hook being a device for hanging.

5. A wire-form mannequin according to claim 4 wherein said chest support wire comprises a singular-curve chest support wire, said singular-curve chest support wire having a shape of a smooth curve line.

6. A wire-form mannequin according to claim 4 wherein said chest support wire comprises a feminine chest support wire, said feminine chest support wire having a shape of a twin-peak curve line.

7. A wire-form mannequin comprising a wire bent to provide a plurality of portions including a neck plateau portion, a first shoulder support portion, a second shoulder support portion, a first lateral support portion, a second lateral support portion, a first hip portion, and a second hip portion, a first wire end cap, a second wire end cap, a chest support wire, an abdominal support wire, and a head hanger hook, said neck plateau portion having a first end being extended into one end of said first shoulder support portion and having a second end being extended into one end of a second shoulder support portion, said first shoulder support portion having another end being extended into one end of the first lateral support portion, said second shoulder support portion having another end being extended into one end of the second lateral support portion, said first lateral support portion having another end being extended into one end of the first hip portion, said second lateral support portion having another end being extended into the second hip portion, said first hip portion having a first hip wire end which is inserted into the first end cap, said second hip portion having a second hip wire end which is inserted into the second end cap, said chest support wire having one end being connected to where said end of said first shoulder support portion meets said end of said first lateral support portion, and having another end being connected to where said end of said second shoulder support portion meets said end of said first lateral support portion, said abdominal support wire having one end being connected to where said end of said first lateral support portion meets said end of said first hip support portion, and having another end being connected to where said end of said second lateral support portion meets said end of said first hip support portion, and said head hanger hook being attached to a middle position of said neck plateau portion and being a device for hanging.

8. A wire-form mannequin according to claim 7 wherein said chest support wire comprises a singular-curve chest support wire, said singular-curve chest support wire having a shape of a smooth curve line.

9. A wire-form mannequin according to claim 7 wherein said chest support wire comprises a feminine chest support wire, said feminine chest support wire having a shape of a twin-peak curve line.

10. A wire-form mannequin comprising a wire bent to provide a plurality of portions including a first lateral hook, a second lateral hook, a first lateral support portion, a second lateral support portion, a first hip portion, a second hip portion and a torso end loop portion, a chest support wire, an abdominal support wire, a holder connecting wire, and a cylindrical stand holder, a non-hook end of said first lateral hook having a first curved tail which is extended into one end of said first lateral support portion, a non-hook end of said second lateral hook having a second curved tail which is extended into one end of said second lateral support portion, another end of said first lateral support portion being extended into one end of said first hip portion, another end of said second lateral support portion being extended into one end of said second hip portion, another end of said first hip portion and another end of said second hip portion being extended to form the torso end loop portion, said chest support wire having one end being connected to where said end of said first shoulder support portion meets said end of said first lateral support portion, and having another end being connected to where said end of said second shoulder support portion meets said end of said second lateral support portion, said abdominal support wire connecting said first lateral support portion and said second lateral support portion, said abdominal support wire having one end being connected to where said end of said first lateral support portion meets said end of said first hip portion, and having another end being connected to where said end of said second lateral support portion meets said end of said second hip portion, said holder connecting wire having one end being connected to said first hip portion and having another end being connected to said second hip portion, and said cylindrical stand holder being attached to a middle position of said holder connecting wire.

11. A wire-form mannequin according to claim 10 wherein said chest support wire comprises a singular-curve chest support wire, said singular-curve chest support wire having a shape of a smooth curve line.

12. A wire-form mannequin according to claim 10 wherein said chest support wire comprises a feminine chest support wire, said feminine chest support wire having a shape of a twin-peak curve line.

* * * * *